US008317612B2

(12) United States Patent
Guthrie et al.

(10) Patent No.: US 8,317,612 B2
(45) Date of Patent: Nov. 27, 2012

(54) SPORTS NET WITH SOCKS AND PROMOTION METHOD USED THEREWITH

(76) Inventors: David W Guthrie, Indianapolis, IN (US); George Baumgardner, Longport, NJ (US)

( * ) Notice: Subject to any disclaimer, the term of this patent is extended or adjusted under 35 U.S.C. 154(b) by 611 days.

(21) Appl. No.: 12/547,445

(22) Filed: Aug. 25, 2009

(65) Prior Publication Data

US 2010/0048299 A1 Feb. 25, 2010

Related U.S. Application Data

(60) Provisional application No. 61/091,508, filed on Aug. 25, 2008.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |
| *A63B 69/00* | (2006.01) |
| *A63B 69/38* | (2006.01) |
| *A63B 63/00* | (2006.01) |

(52) U.S. Cl. ..... 463/31; 473/422; 473/439; 473/454; 473/462; 473/478

(58) Field of Classification Search ..... None
See application file for complete search history.

(56) References Cited

U.S. PATENT DOCUMENTS

| | | | | |
|---|---|---|---|---|
| 4,955,967 | A * | 9/1990 | Houriet et al. | 273/372 |
| 5,776,021 | A * | 7/1998 | Rakonjac | 473/588 |
| 5,953,076 | A | 9/1999 | Astle et al. | |
| 2005/0187037 | A1 * | 8/2005 | Campbell et al. | 473/378 |
| 2008/0293522 | A1 * | 11/2008 | Kaleel et al. | 473/462 |

* cited by examiner

*Primary Examiner* — Dmitry Suhol
*Assistant Examiner* — Kevin Y Kim
(74) *Attorney, Agent, or Firm* — Taft Stettinius & Hollister LLP; Keith Swedo, Esq.

(57) ABSTRACT

A net or barrier has strategically located pocket(s) attached to the net over holes(s) in the net/barrier in order to catch a ball or projectile that passes through the hole(s). A computer-assisted method displays information, more particularly advertisement, onto a net or barrier. The computer-assisted display is viewable by a TV or video audience.

6 Claims, 7 Drawing Sheets

SPORTS NET WITH SOCKS AND PROMOTION METHOD USED THEREWITH

CROSS REFERENCES TO RELATED APPLICATIONS

The present application is a non-provisional of, and claims priority to, U.S. Provisional Patent Application No. 61/091,508 filed on Aug. 25, 2008.

BACKGROUND OF THE INVENTION

1. Field of the Invention

The present invention relates generally to nets for catching balls or other projectiles and methods for conducting marketing promotions in conjunction with the use of such nets.

2. Description of the Related Art

Typically, nets, barriers etc, make up a large part of sports apparatus. Nets are used in a number of games, typically to catch the ball being used to play the game. Nets are typically used to verify the placement of the projectile in an effort to validate scoring. Nets are used behind the goal posts of a football game during point after tries and field goal attempts, behind the batter's box, as part of the out of play posts of a baseball game, to catch the ball and to verify a goal during a soccer match, and similarly to catch the puck and to verify a goal in a hockey game. This is true for countless other games. At times nets are used to redirect the ball in an effort to make projectile recovery more effective, e.g., American football field goals and point-after-touchdowns. These nets are viewable by the TV, video audience as well as the attending stadium audience. These nets provide for a high profile, highly viewed, highly impact area to generate advertising impressions. However, it may not be practical to use this space for advertisement without distracting the participating players.

Traditionally, notifications and advertisements are located on tangible things such as billboards, buildings, vehicles, newspapers, magazines, etc. Occasionally, advertisement/notifications are placed on conventional signage that is changeable so as to allow multiple advertisers to time-share the same space, but this type of signage is more expensive and thus does not make up a majority of advertisement opportunities. There are situations in which a suitable, conventional advertising type and placement would be difficult or impossible, distracting or objectionable, for a number of reasons.

SUMMARY OF THE INVENTION

The present invention may be directed to a strategically sized net/barrier/apparatus, capable of stopping a ball or other targeted projectile(s). The net includes as few as one strategically sized hole(s) that allows a ball to pass through the net and into a corresponding pocket that has been secured to the net on the non-field side of the net for the purpose of receiving and holding the ball/projectile. The net may have one or more advertisements displayed on the net via conventional print methods, projection methods, or on a video display screen via computer-enhanced methods. In the computer-enhanced methods, the net may be enhanced in such a way as to support computer enhancement technologies capable of superimposing on the net information or images that are viewable on a television or other video screen.

The invention may add another element of interest to each of these games by placing a strategically sized hole(s) in these nets or barriers with a pocket attached so as to catch the ball or other projectile as it passes through the net/barrier. The pocket may provide verification that the ball passed through the hole in the net by virtue of the ball or projectile becoming securely held in the pocket. A number of schemes can be associated with each hole. A notice or an advertiser can be associated with each hole and with the scheme in the event that the ball passes through the hole and into the corresponding pocket that is associated with the particular advertiser.

The invention may employ altered or newly designed nets that may have strategically placed holes, each of which would may be in communication with an appropriately sized pocket capable of receiving and securing the object. The net may be used to market, advertise, and promote, while the pocket may verify that the ball or projectile passed through the hole in the net and into the pocket. Verification of the ball or projectile passing through the net can be used for a number of schemes. In another embodiment, an advertisement may be projected onto a properly constructed and equipped net that does not include any holes or pockets.

The present invention may also be directed to a system and method to create advertising revenue, gaming revenue or advertising impressions. Information and/or images may be printed directly on the net, projected onto the net (e.g., laser projection), or the information/images may be superimposed on the net. The superimposition may be performed via chroma key, color keying, color-separation overlay, greenscreen and bluescreen technology, or other computer-supported technology capable of enhancing or superimposing information/images on the net that are viewable on a television or other video display. The viewable information/images may be located so as to be identified with, or associated with, a particular hole and pocket. Advertisers may purchase advertising space on the net and, by use of one of the aforementioned methods, the advertisers' information/images may be viewable by large audiences. The advertising space may be associated with a particular hole and pocket. The advertiser may respond to a successful capture of a ball that passes through the hole and into the pocket that are disposed within the advertiser's area on the net.

In situations in which a suitable, conventional advertising type and placement would be undesirable, the present invention may provide a computer-assisted image. An advantage of the invention over conventional shared-space technology may be that such a computer-assisted image provides a more affordable way for advertisers to share advertising space. Another advantage is that advertisers can have their advertisement projected onto the net using computer-assisted methods, viewable only to the TV and video viewing audience. Since the advertisement cannot be seen directly by the players or stadium audience, the advertisement does not distract or diminish the actual game.

BRIEF DESCRIPTION OF THE DRAWINGS

The above-mentioned and other features and advantages of the invention will become more apparent to one with skill in the art upon examination of the following figures and detailed description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PRESENTLY PREFERRED EMBODIMENTS

The invention is described herein as specific embodiments to clearly articulate the invention to one skilled in the existing net art and supporting art of advertising. Additionally, the invention may be implemented and applied using modifications without departing from the spirit and overall scope of the invention.

Figure 1:
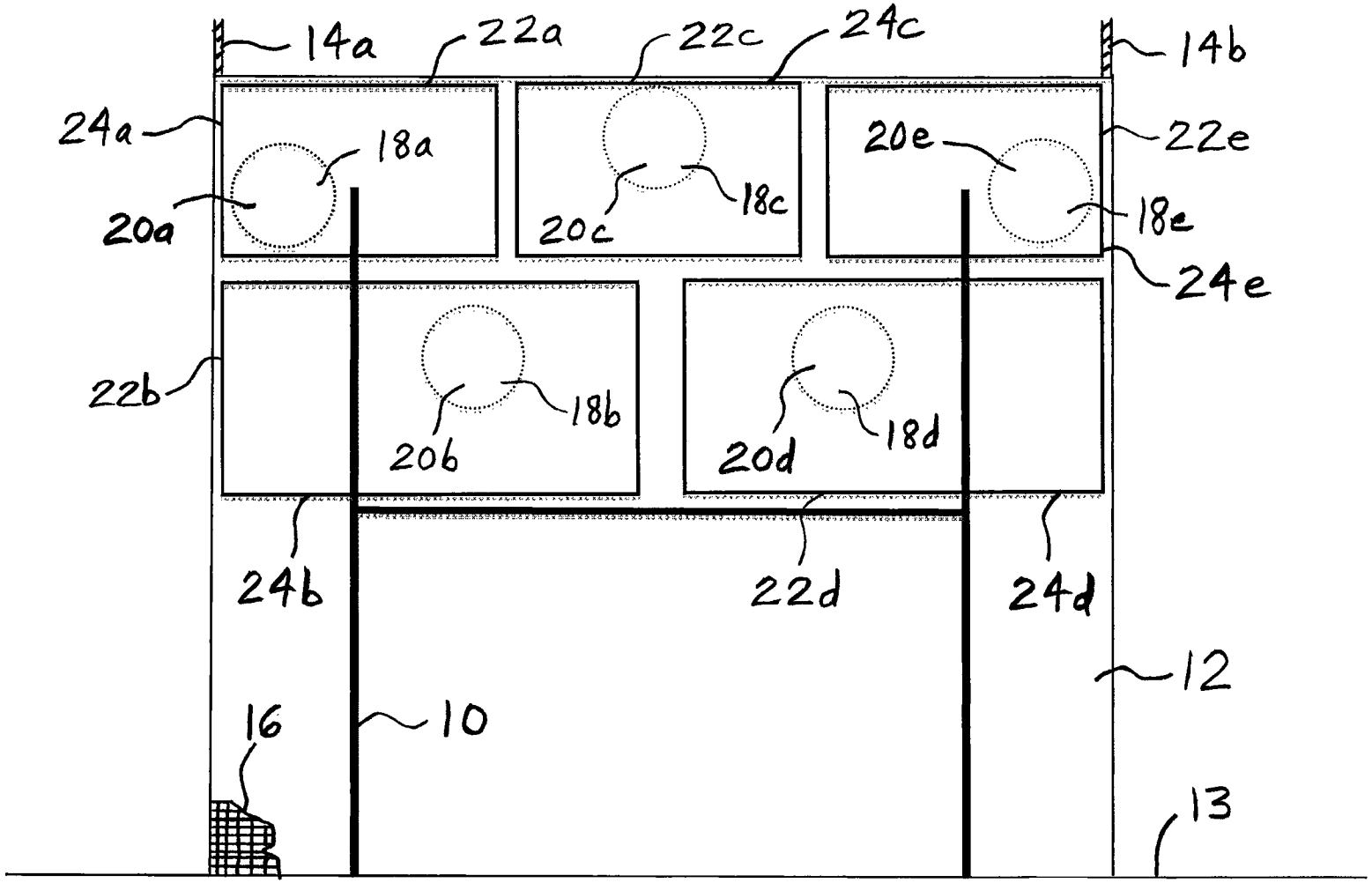
FIG. 1 is a plan view of one embodiment of a net of the present invention disposed behind a football goal post.
Figure 2:
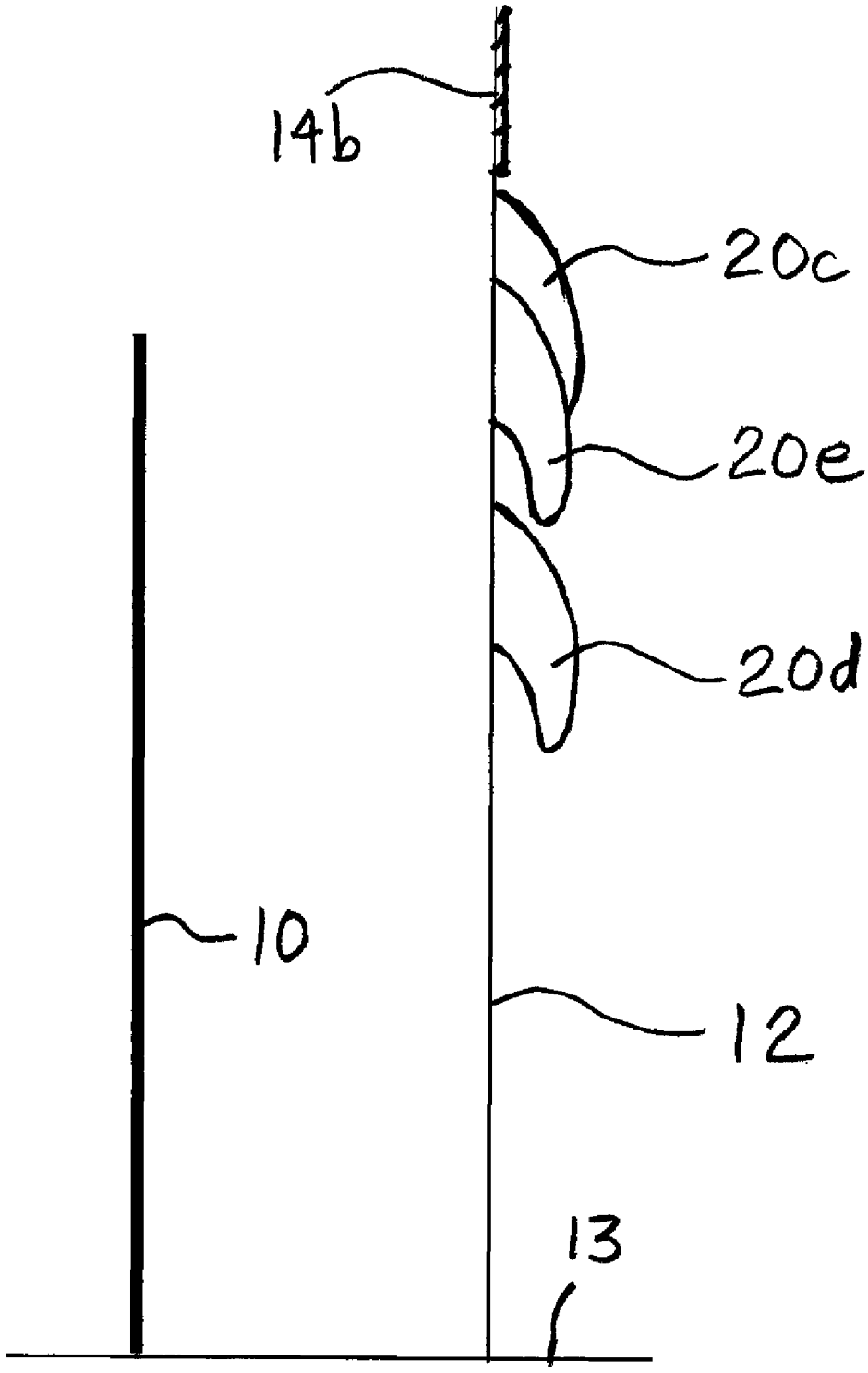
FIG. 2 is a right-side view of the net and goal post of FIG. 1.

Referring to FIG. 1, there is shown one embodiment of a football goal post 10 and net 12 of the present invention supported in an upright position on a ground surface 13 by a pair of substantially vertical cables 14*a*, 14*b*. Net 12 is in the form of a point-after-try/field goal net that is typically used to redirect a football in order to make ball retrieval more effective. The body of net 12 may include interlaced fabric or webbing, which is fragmentarily shown at 16, but which is not shown throughout net 12 in order to avoid cluttering the drawing. Net 12 may include circular holes 18*a-e* in communication with respective pockets 20*a-e*, a few of which are best visible in FIG. 2.

Each pocket 20*a-e* may be sized to securely capture and retain the football passing thereinto without allowing the football to bounce back through the hole and away from net 12. In one embodiment, the volume of each pocket 20*a-e* may be on the order of ten times larger than the football or projectile that the pocket captures. Pockets 20*a-e* may be made of the same material that the body of net 12 is made of.

Holes 18*a-e* may be sized such that a football or other projectile may easily pass therethrough, although the exact size of holes 18*a-e* may be a design choice. Holes 18*a-e* may have other shapes other than circular.

Each of holes 18*a-e* may be disposed with a respective, associated advertising area 22*a-e*, each of which may include an advertising image of a respective sponsor or product. The advertisements may be printed on net 12, projected thereon, such as by laser projection, or may be superimposed only on electronic images of the net as displayed on video screens via computer-assisted technology.

In one embodiment, each advertising area 22*a-e* may be defined and/or delineated by a respective electronic marking device in the form of a respective cord 24*a-e* that emits infrared (IR) energy. In the embodiment of FIG. 1, each cord 24*a-e* is arranged in a rectangle having opposite upper and lower sides and opposite left-hand and right-hand sides.

In one embodiment of a promotional arrangement 26 (FIG. 3) of the invention, an image-capturing device in the form of an IR energy-sensitive camera 28 detects the IR energy emitted by, and thus the location of, each of the four sides of each of cords 24*a-e*. As net 12 is unfurled for an extra point or field goal try, camera 28 may detect when a vertical distance 30 between the upper and lower sides of cord 24*d*, for example, has grown to a threshold distance. More particularly, camera 28 may receive both IR energy 32 from the upper side of cord 24*d* and IR energy 34 from the lower side of cord 24*d*.

Figure 3:
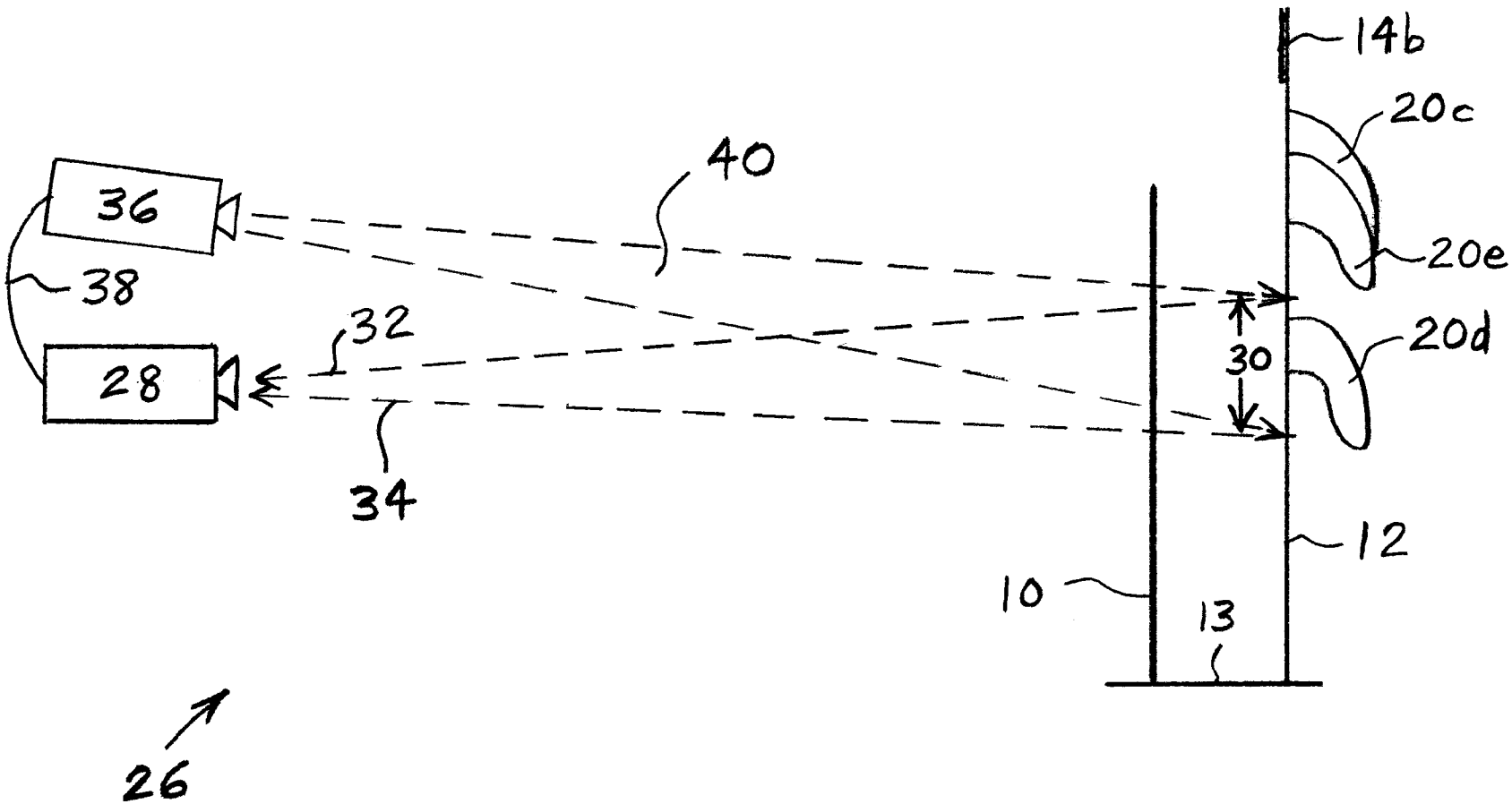
FIG. 3 is a right-side view of one embodiment of a promotional arrangement including the net and post of FIGS. 1 and 2.

In response to detecting when vertical distance 30 between the upper and lower sides of cord 24*d* has achieved a threshold distance, camera 28 may notify a laser projector 36 to project an advertisement onto advertising area 22*d*, as indicated in FIG. 3 by beam 40. Alternatively, camera 28 may continuously inform projector 36 via line 38 of the magnitude of distance 30, and projector 36 may project an advertisement whose size and dimensions always match those of advertising area 22*d*. That is, the projected advertisement may grow with advertising area 22*d*. Further, camera 28 may inform projector 36 of the exact locations of each of the upper, lower, right-hand side and left-hand side of cord 24*d* so that the projected advertisement may hit, or be registered with, the target provided by advertising area 22*d*. The same procedure, or a similar procedure, may be followed with projecting advertising on each of the other advertising areas 22*a-c* and 22*e*.

Another embodiment of a promotional arrangement 126 (FIG. 4) of the invention includes an IR sensitive camera 128 that detects the IR energy emitted by, and thus the location of, each of the four sides of each of cords 24*a-e*. In this embodiment too, as net 12 is unfurled for an extra point or field goal try, camera 128 may detect when a vertical distance 30 between the upper and lower sides of cord 24*d*, for example, has grown to a threshold distance. More particularly, camera 128 may receive both IR energy 32 from the upper side of cord 24*d* and IR energy 34 from the lower side of cord 24*d*. In addition, camera 128 may receive IR energy, as indicated at 42, from an IR energy-emitting cord (not shown) that is arranged in a circular shape along the boundary of hole 18*d*.

In response to detecting when vertical distance 30 between the upper and lower sides of cord 24*d* has achieved a threshold distance, camera 128 may notify a video processor in the form of a rasterization engine 136 via a line 44 to superimpose an advertisement onto advertising area 22*d* within a video signal 46. Video signal 46 may include the image captured by camera 128 and may be received by a video monitor 48. It is to be understood that video signal 46 may also be broadcast via cable or radio frequency transmitters to large numbers of televisions or other video monitors 48 that are tuned to the football game that is being televised.

Figure 4:
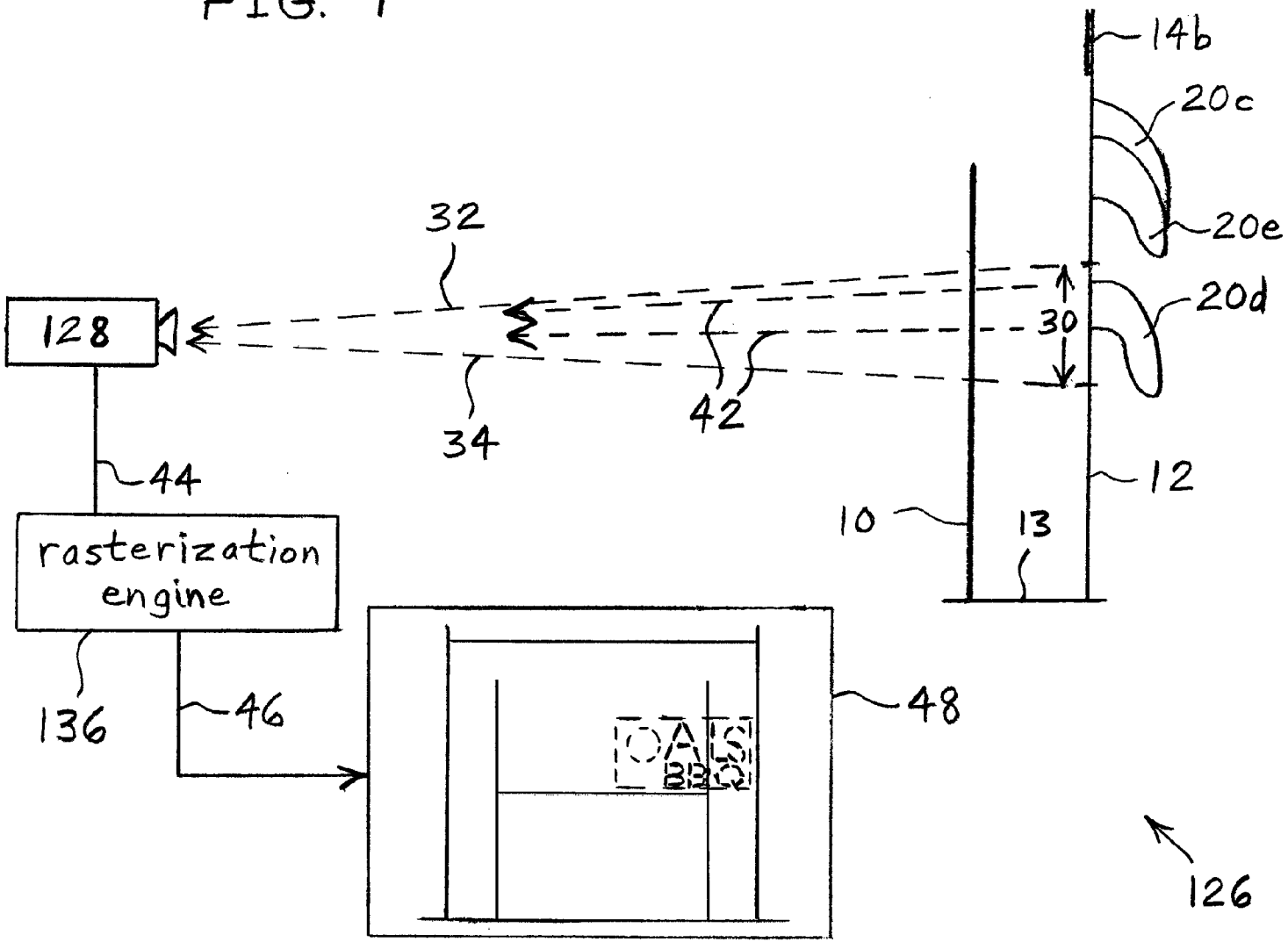
FIG. 4 is a right-side view of another embodiment of a promotional arrangement including the net and post of FIGS. 1 and 2.

In the embodiment of FIG. 4, the superimposed advertisement is illustrated in dashed lines and includes the words "ALS BBQ", a company that may pay money for the advertisement. Also superimposed on the image may be a video enhancement of the circular boundary of hole 18*d* and possibly of the rectangular boundary of advertising area 22*d*, each of which is shown in FIG. 4. The superimposed video enhancement may be in the form of semi-transparent, colored or multi-colored lines or "highlighted" or "watermark" lines which merely color and do not obstruct the corresponding portions of the image captured by camera 128. The highlighting of the circular boundary of hole 18*d* may make it easier for a viewer to see when the football goes through hole 18*d* and into pocket 20*d*. Similar superimposed images corresponding to advertising areas 22*a-c* and 22*e* may also be included in video signal 46, but are omitted from FIG. 4 in order to preserve the clarity of the illustration.

Alternatively, camera 128 may continuously inform rasterization engine 136 via line 44 of the magnitude of distance 30, and engine 136 may superimpose an advertisement whose size and dimensions always match those of advertising area 22*d*. That is, the projected advertisement may grow with advertising area 22*d*. Further, camera 128 may inform engine 136 of the exact locations of each of the upper, lower, right-hand side and left-hand side of cord 24*d* so that the superimposed advertisement may hit, or be registered with, the target provided by advertising area 22*d*. The same procedure, or a similar procedure, may be followed with superimposing advertising on each of the other advertising areas 22*a-c* and 22*e*.

Net 12 may be further altered, designed, equipped, added onto or adjusted in order to accommodate any computer assisted imaging requirement needed to display a virtual image on the net. Net 12 may be altered, and or equipped to accommodate any computer-assisted virtual imaging requirements and, in one embodiment, does not include any holes or pockets. In this embodiment, the net may be used for advertising without the added feature and use of the holes and/or pockets.

Figure 5:
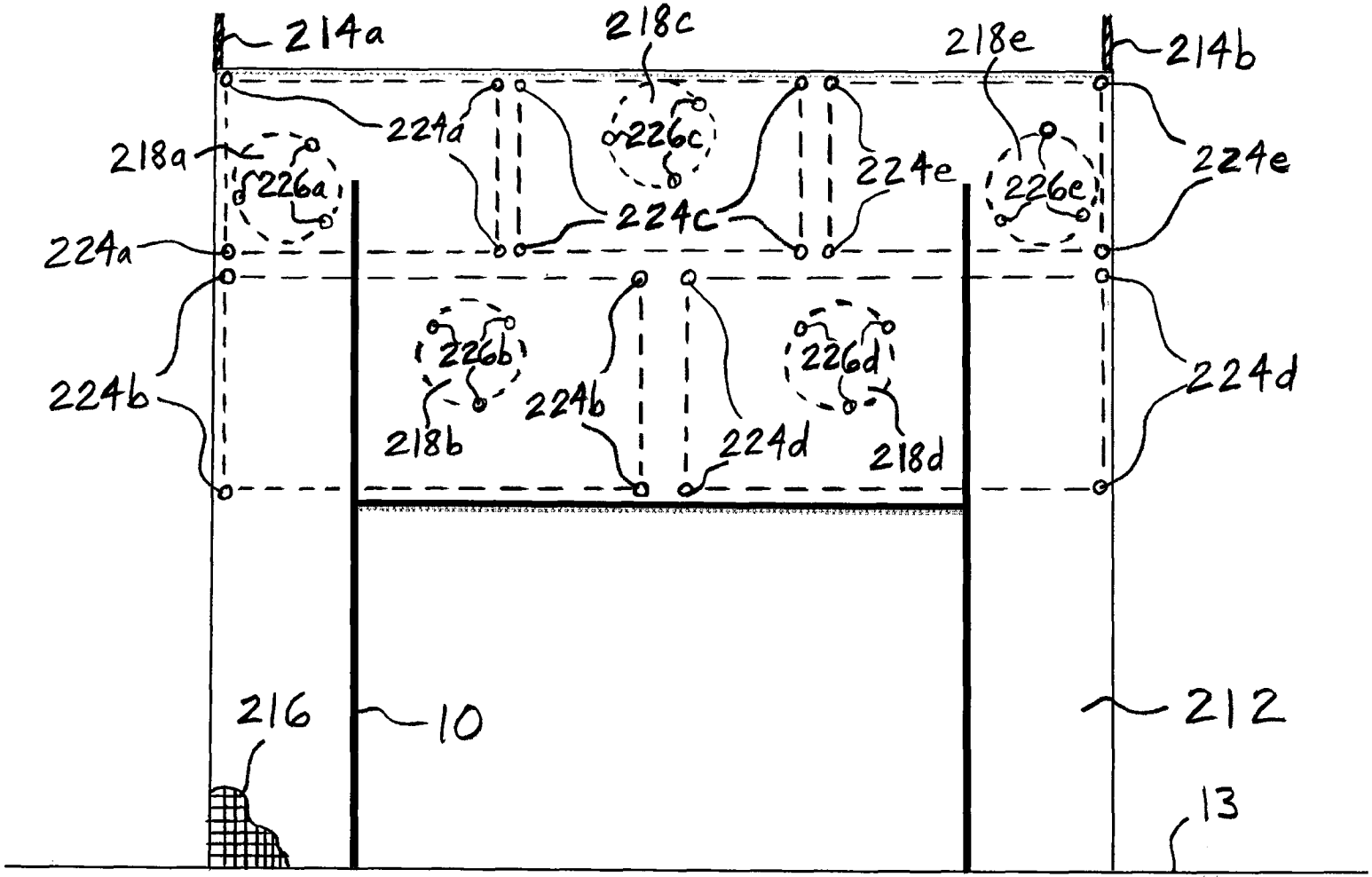
FIG. 5 is a plan view of a goal post and another embodiment of a net of the present invention.

Another embodiment of a net 212 shown in FIG. 5 is formed of web material, as fragmentarily indicated at 216, and is supported by cables 214*a-b*. Net 212, instead of having IR energy-emitting cords 24, has IR energy-emitting bulbs or point-sources of IR energy 224*a-e* and 226*a-e*. The four corners of each advertising area 222*a-e* are defined by IR energy-emitting bulbs 224*a-e*, respectively. Similarly, circular holes 218*a-e* are each defined by a respective set of three IR energy-emitting bulbs 226*a-e*.

An IR-sensitive camera (not shown) may detect the location of each of bulbs 224, 226, and thus may determine where in the televised image to superimpose the advertising, the boundaries of the advertising, and/or the boundaries of holes 218. In order to differentiate the locations of bulbs 224 from the locations of bulbs 226, bulbs 224 may emit IR energy having discernibly different characteristics than the IR energy emitted by bulbs 226. For example, bulbs 224 may emit IR energy having a different energy level and/or frequency than the IR energy emitted by bulbs 226.

IR energy-emitting cords and bulbs are just two examples of numerous methods within the scope of the invention for locating the advertising areas within the net. As another example, transmitter/receiver pairs may be attached to opposite edges of the net, and these transmitter/receiver pairs may be used to superimpose watermark lines on the net, similarly to the method in which first-down lines are superimposed onto televised football broadcasts using the systems utilized by Sportvision, Inc., Princeton Video Image, Inc., and/or SportsMEDIA. Similar methods that may be employed by the invention include those disclosed in U.S. Pat. No. 5,953,076 by Astle et al. which is hereby incorporated by reference herein in its entirety.

Figure 6:
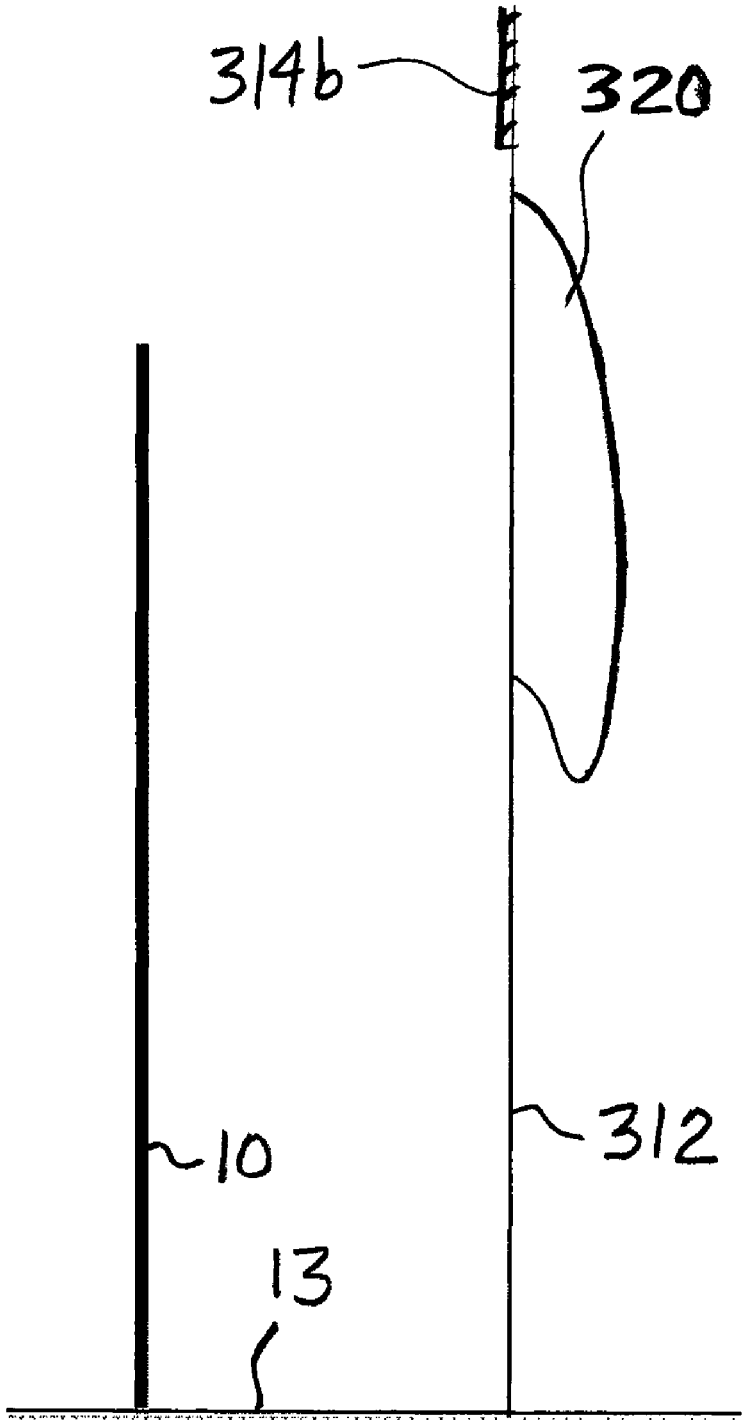
FIG. 6 is a right-side view of a goal post and yet another embodiment of a net of the present invention.

Yet another embodiment of a net 312 of the present invention is illustrated in FIG. 6. Instead of each hole 18 having its own individual pocket 20, each of the holes in net 312 is in communication with a same, common pocket 320. Other features of net 312 may be substantially similar to those of net 12 and/or net 212.

According to at least some embodiments of the invention, advertising space may be offered to advertisers who pay to have their advertisement electronically made viewable by the TV or video audience. The advertisement may be viewable on the field side of the net, the non-field side of the net, or both, depending upon the preference of the advertising space provider and the advertising purchaser.

In some embodiments, the holes and pockets may be strategically sized and located in order to allow a scheme to be designed around the fact that there is a respective probability that the kicker will kick the football into any one of the holes. The scheme may involve entertainment, marketing, promotion, advertising, rewarding consumers, as well as adding a game to the primary game.

The invention may be used as entertainment as a game and/or to promote a game, a product, a service, an entity, a person or any other known thing. The pockets may be identified or marked using standard, visible text, electronic method(s) or other methods. The promotion may or may not trigger a predetermined outcome when a projectile (e.g., ball, puck, etc.) enters one of the pockets.

The invention may be used in marketing as a game and/or to promote a game, a product, a service, an entity, a person or any other known thing. The pockets may be identified or marked using standard, visible text, electronic method(s) or other methods. The pockets/openings may be valued based on their placement, size, impressions, etc. The promotion may or may not trigger a predetermined outcome when a projectile (e.g., ball, puck, etc.) enters one of the pockets.

The invention may be used in promotion as a game and/or to promote a game, a product, a service, an entity, a person or any other known thing. The pockets may be identified using standard, visible text, electronic method(s) or other methods. The pockets/openings may be valued based on their placement, size, impressions etc. The promotion may or may not trigger a predetermined outcome when a projectile (e.g., ball, puck, etc.) enters one of the pockets.

The invention may be used in advertising as a game, and/or to promote a game, a product, a service, an entity, a person or any other known thing. The pockets may be identified and used as advertising space. The pockets/openings may be valued based on their placement, size, impressions, etc. The advertising space is noted or marked using standard, visible text, electronic method(s) or other methods. The advertiser may or may not execute a predetermined outcome should a projectile (e.g., ball, puck, etc.) enter the advertiser's pocket.

The invention may be used as a game to reward consumers. Participants may participate at no cost to them or may pay to participate. The pockets/openings may be valued based on their placement, size, etc. The pockets may be identified using standard, visible text, electronic method(s), or other methods. A predetermined reward may be delivered to the winning participant(s) should a projectile (e.g., ball, puck, etc.) enters one of the pockets, or a series of pockets, identified by the participant(s).

In one embodiment, a user of the invention, e.g., the National Football League, would contract for a fee with companies to provide advertising space and other advertising benefits to participating companies by displaying each participating company's graphic on the net associated with a particular pocket when the net is displayed. The graphic may or may not be displayed on both the front and back surface of the net. If computer-assisted superimposition is used, only those people viewing the net on a television or other electronic device capable of displaying the net and the graphic would be able to see the advertisement. The participating companies would agree to donate a predetermined amount of money to a not-for-profit association or charity should the football pass through the hole and enter and remain in the pocket with which the company's advertisement is associated.

In another embodiment, a user of the invention, e.g., the National Football League, would contract for a fee with companies to provide advertising space and other advertising benefits to participating companies by displaying each participating company's graphic on the net associated with a particular pocket when the net is displayed. The graphic may or may not be displayed on both the front and back surface of the net. If computer-assisted superimposition is used, only those people viewing the net on a television or other electronic device capable of displaying the net and the graphic would be able to see the advertisement. Ticket holders attending the event are encouraged to keep their numbered ticket stubs. A respective ticket number is randomly selected in associated with each company logo/pocket prior to the use of the net. Should the football enter and remain in the pocket with which a company's advertisement and randomly selected ticket number is associated, the person holding the randomly selected ticket number is awarded a predetermined gift.

In yet another embodiment, a user of the invention, e.g., the National Football League, would contract for a fee with companies to provide advertising space and other advertising benefits to participating companies by displaying each participating company's graphic on the net associated with a particular pocket when the net is displayed. The graphic may or may not be displayed on both the front and back surface of the net. If computer-assisted superimposition is used, only those people viewing the net on a television or other electronic device capable of displaying the net and the graphic would be able to see the advertisement. A not-for profit entity is assigned all of the available pockets on the net, or a number of not-for-profit entities are assigned one or more of the available pockets on the net. Each pocket is individually identified using a standard or electronic method, e.g., 1, 2, 3; or A, B, C. Each not-for-profit entity sells chances/contributions to legally qualified individuals in states where such sales are legal with a promise to distribute a portion of such contributions should the football enter and remain in the pocket identified with the not-for-profit that sold the chance to the qualifying individual. Each sold contribution may be numbered, and prior to or after the football enters and remains in the pocket associated with the not-for-profit, the not-for-profit may randomly select a number from the available numbered contributions.

In still another embodiment, a user of the invention, e.g., the National Football League, would contract for a fee with companies to provide advertising space and other advertising benefits to participating companies by displaying each participating company's graphic on the net associated with a particular pocket when the net is displayed. The graphic may or may not be displayed on both the front and back surface of the net. If computer-assisted superimposition is used, only those people viewing the net on a television or other electronic device capable of displaying the net and the graphic would be able to see the advertisement. Participating companies may agree to provide a gift to each person holding a ticket to the event should the football enter and remain in the pocket over which a company's advertisement is displayed. For example, in the event that the football enters and remains in the pocket identified with Hooters®, Hooters® agrees to provide free of charge to all ticket holders a serving of chicken wings.

Figure 7:
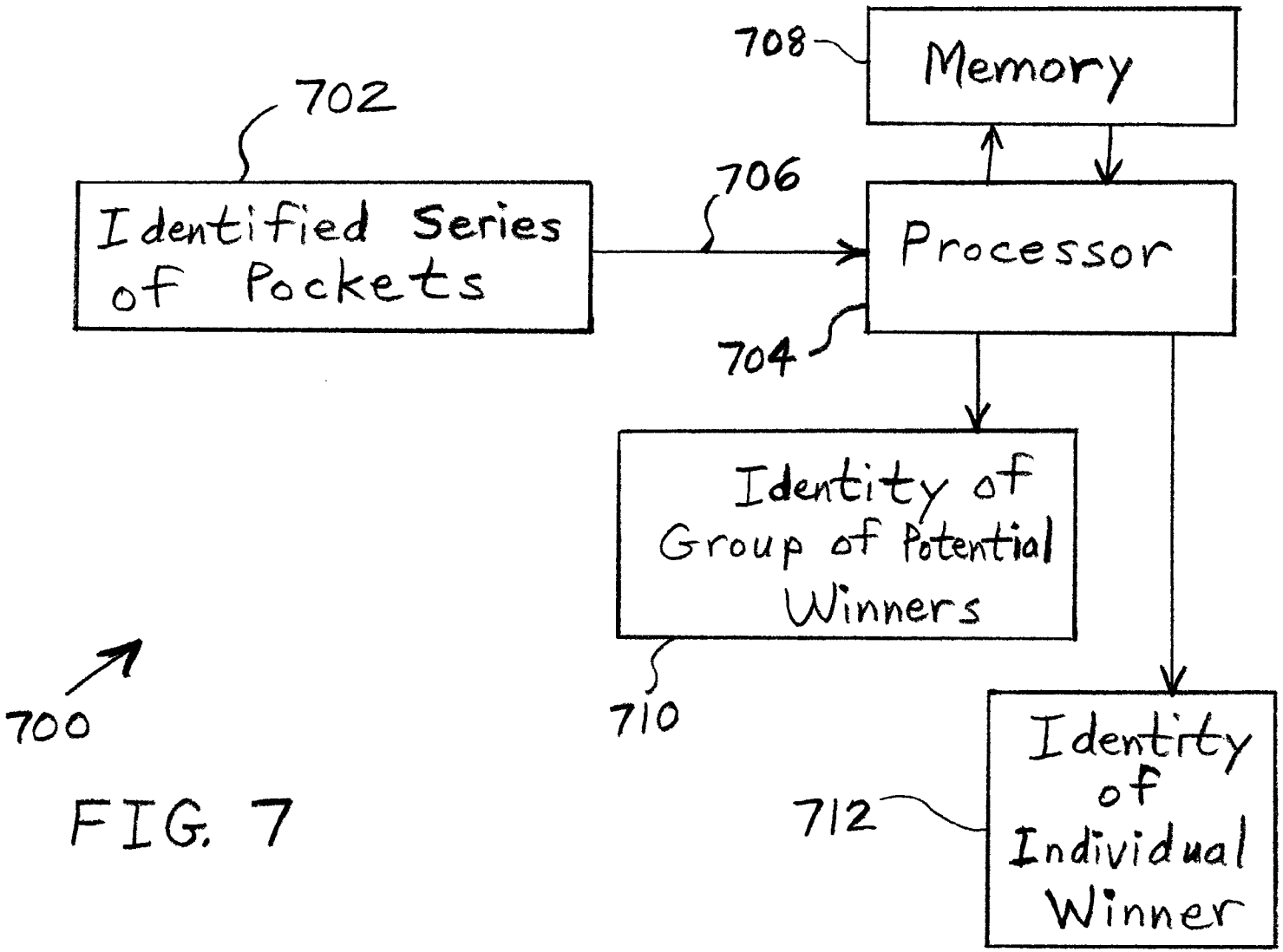
FIG. 7 is a block diagram of one embodiment of a promotion arrangement of the present invention.

Each of the above methods may be implemented via use of a computer that is programmed to carry out the promotion as described. Another example of a computer—(e.g., processor—) based promotion arrangement 700 of the invention is shown in FIG. 7. In block 702 a sequential series of pockets that receive and retain a football are automatically or manually entered into a computer system and transmitted to an electronic processor 704, as indicated at 706. The identified pockets may be in the same net, or may be in multiple nets being used in different games within the football league. The sequential series of pockets may be those that retain footballs in a particular game, on a particular day in multiple games around the league, or over the course of a football season, for example.

Memory device 708 may contain a list of human contest participants as well as the corresponding series of pockets that is associated with each participant. Each participant may choose his own corresponding series of pockets, or a randomly chosen series of pockets may be assigned to each participant. In one embodiment, a person becomes one of the participants by virtue of purchasing a particular product or service. Processor 704 may retrieve from memory 708 the identity or identities of the group of contestants whose assigned series of pockets is consistent with the series transmitted at 706. For example, each participant may have a sequential series of eight pockets assigned to him, and the sequential series provided at 706 may be only four pockets long. Thus, a group of people may have series that are consistent with the shorter series provided at 706, and hence there may be a group or plurality of potential winners identified by processor 704 in block 710. The identity of potential winners at 710 may be a section and row of the football stadium, or may be a list of names of the potential winners, for example. This identity 710 may be automatically electronically displayed within the stadium, or may be automatically displayed on an internet web site, etc.

As subsequent kicked balls are retained by various holes and pockets, the group of potential winners identified at 710 may become smaller, i.e., is whittled down to a smaller number of potential winners. With each subsequent capture of a football by one of the pockets, the identity of the potential winners may be updated in real time, and the displayed identity of the group of potential winners may also be updated in real time. Eventually, after a sufficient number of pockets have captured a football, a single winner of the contest may be identified at block 712. That is, the sequential list of pockets associated with the winner may match the sequential list of pockets that captured footballs in reality.

The invention has been described herein as being applied to a football net. However, it is to be understood that the invention may be equally applied to nets or barriers in other sports, such as hockey, soccer, and baseball, to name a few.

The net of the invention has been described as having pockets in communication with the throughholes of the net. However, the scope of the invention may encompass nets without pockets wherein the projectile may pass through the net and fall to the ground on the other side of the net.

While the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A method of conducting a contest, the method comprising the steps of:

providing at least one barrier for a sports projectile, each said barrier having a plurality of targets thereon;

assigning a corresponding sequence of the targets to each of a plurality of contestants in the contest;

recording in an electronic memory device an identity of each of the contestants in association with the contestant's corresponding sequence of the targets;

in response to at least one game involving the at least one barrier, communicating to an electronic processor an actual sequence of the targets that receive said sports projectile during the at least one game; and using the processor to retrieve from the memory device at least one identity associated with at least one of the contestants whose corresponding assigned sequence of the targets is consistent with the actual sequence of the targets.

2. A method as in claim 1 comprising the further steps, in response to another said target receiving said sports projectile during the game, of:

updating the actual sequence of the targets; and using the processor to retrieve from the memory device at least one identity associated with at least one of the contestants whose corresponding assigned sequence of the targets is consistent with the updated actual sequence of the targets.

3. A method as in claim 2 in which the updating and using steps are repeated in response to subsequent receptions of said sports projectile until there is only one said contestant whose corresponding assigned sequence of the targets is consistent with the updated actual sequence of the targets.

4. A method as in claim 1 comprising the further step of automatically electronically displaying the at least one identity associated with at least one of the contestants whose corresponding assigned sequence of the targets is consistent with the actual sequence of the targets.

5. A method as in claim 1 in which the corresponding sequence of the targets is assigned to at least one said contestant in response to the at least one contestant purchasing a product or service.

6. A method as in claim 1 in which the at least one identity comprises a section of seating in a stadium in which at least one said game is played.

* * * * *